United States Patent [19]

Fischbach

[11] Patent Number: 4,845,891

[45] Date of Patent: Jul. 11, 1989

[54] HARDWARE FOR CLOSURE

[75] Inventor: Karl H. Fischbach, Freudenberg, Fed. Rep. of Germany

[73] Assignee: Siegenia-Frank KG, Siegen, Fed. Rep. of Germany

[21] Appl. No.: 130,025

[22] Filed: Dec. 4, 1987

[30] Foreign Application Priority Data

Dec. 12, 1986 [DE] Fed. Rep. of Germany ..... 3642505

[51] Int. Cl.[4] ..... E05D 15/10

[52] U.S. Cl. ..... 49/219; 49/129

[58] Field of Search ..... 49/219, 129, 130, 220

[56] References Cited

U.S. PATENT DOCUMENTS

| | | | |
|---|---|---|---|
| 2,741,807 | 4/1956 | Powers | 49/219 |
| 4,384,429 | 5/1983 | Rokicki et al. | 49/219 X |
| 4,551,945 | 11/1985 | von Resch | 49/130 X |
| 4,590,707 | 5/1986 | von Resch | 49/130 |

FOREIGN PATENT DOCUMENTS

| | | |
|---|---|---|
| 0090956 | 10/1983 | European Pat. Off. . |
| 1043866 | 11/1958 | Fed. Rep. of Germany . |
| 3234677 | 3/1984 | Fed. Rep. of Germany . |
| 3435367 | 4/1985 | Fed. Rep. of Germany . |
| 1551381 | 11/1968 | France . |
| 8203515 | 4/1984 | Netherlands . |

*Primary Examiner*—Philip C. Kannan

*Attorney, Agent, or Firm*—Blodgett & Blodgett

[57] ABSTRACT

Hardware for the closure of a door or window which is constructionally simple and functionally reliable, permitting movement of the closure out of the frame to a parallel position and allowing horizontal shifting in this position. Lower supporting arms are pivotally mounted on the closure and two traveling carriages are associated with the supporting arms and with an associated bearing block at the side of the closure. The carriages are designed in mirror-image relationship, so that the carriages are movable in opposite directions by means of a differential coupling gear.

4 Claims, 5 Drawing Sheets

HARDWARD FOR CLOSURE

BACKGROUND OF THE INVENTION

The present invention relates to hardware for the closure of a window or door, which closure is movable to a parallel-stop position and in this position is horizontally shiftable. It is provided with lower supporting arms and upper swing arms. The lower supporting arms are always pivotally connected on the one hand to the lower transverse closure bar in a bearing block and on the other hand to traveling carriages. A releasable blocking device is provided for at least one of the lower supporting arms, when it is located in the parallel-stop position. The closure can be brought into and out of a shift-close end position relative to the supporting arm.

Hardware of this kind has already been disclosed in the U.S. Pat. No. 2,741,807, and also in the French Patent No. 1,551,381. The advantage of this structure resides in that, they are structurally simple, are rugged, and can, therefore, be used where heavy closures are to be brought into parallel-stop position relative to the stationary frame and then to be shifted horizontally.

The construction principles of these known hardware designs are such that it is necessary to make and store hardware and parts for closures that are horizontally shiftable from their closed position relative to the stationary frame both to the right or to the left in opening direction.

This handicap applies also in the fabrication of the hardware such as has become known through the DE-OS No. 32 34 677.

On the hardware constructed in accordance with U.S. Pat. No. 2,741,807, and FR-PS No. 1,551,381, the releasable blocking device is formed by a supporting lever which in each case has to act over the entire length of the horizontal displacement path for the closure with a frame-side or stationary thrust abutment if the parallel stop position of the swing-out arms is to be locked in any desired slide position.

On the hardware constructed in accordance with DE-OS No. 32 34 677, on the other hand, the blocking device fixing the parallel-stop position of the swing-out arms (between the swing-out arm and the traveling carriage upon which this is mounted) are active in such a way that it moves into or out of active connection in the region of the shift-close end position of the closure with an actuating link stationarily built at the frame side.

These and other difficulties experienced with the prior art devices have been obviated in a novel way by the present invention.

It is, therefore, an outstanding object of the invention to provide hardware of the initially described kind which can be used in one and the same type of construction independent of the fact whether the closure is to be horizontally shifted either to the right or the left direction relative to the stationary frame from the closure position.

With these and other objects in view, as will be apparent to those skilled in the art, the invention resides in the combination of parts set forth in the specification and covered by the claims appended hereto.

SUMMARY OF THE INVENTION

In general, the present invention achieves this object by providing hardware with two traveling carriages constructed with supporting arms and associated bearing blocks at the side of the closure in a mirror-image manner. The carriages can be positively coupled for movement in opposite directions by means of a differential coupling gear.

More specifically, the disengaging device has the bearing pivot pins in the supporting arms in the two bearing blocks mounted on the closure located a greater distance from one another both in the closed position as well as in the parallel-stop position of the closure in direction of the plane of the closure than the bearing pivot pins for these supporting arms in their traveling carriages. The two supporting arms of the hardware operate together in this case through the differential coupling gear in the nature of a positively-controlled trapezoid guide rod system. This permits, along with largest possible supporting width for the closure which has been brought into parallel-stop position, a space-saving accommodation of the traveling carriages underneath the lower transverse closure bar.

It is, however, also conceivable to provide the trapezoid guide rod system of the hardware between the traveling carriage and the closure in such a way that the closure-side pivots of the supporting arms have (in the plane of the closure) a smaller distance from each other than their pivots at the two traveling carriages.

In addition, the hardware construction provides that each traveling carriage carries a thrust piece which engages an articulated connecting rod which is a swivel connection, so that the sliding path of the thrust piece and of the guide rod corresponds relative to the traveling carriage to height of the curve traveled by the end of the supporting arm engaging the closure around its pivot to the traveling carriage.

DE-AS No. 10 43 866 shows hardware for parallel stoppable closures of windows and doors, with two swing arms arranged in mirror-inverted relationship and in each case having a guide rod facing toward the stationary frame which operates with positive control through a coupling gear. In this case, however, the guide rods engaging the swing arm are merely pivotally-movable and are likewise merely pivotably articulated at the stationary frame, while the ends of the swing arms extending towards the stationary frame engage there for opposite shifting movement and have reciprocal control connection through the differential coupling. As a disengaging device for closures of windows and doors, that is parallel stoppable and horizontally shiftable by means of traveling carriages, this known type of construction is not suitable because its swing arms cannot be used as supporting arms which could transfer the weight of the closure to the traveling carriages.

In order to facilitate the adaptation of the hardware to various widths of fabrication of the closures, the thrust pieces of both traveling carriages can be coupled with one another by means of an intermediate piece that can be adjusted.

To solve the task which is the basis of the invention, it is also important that, between each traveling carriage and the supporting arm articulated thereon, be located a blocking device for the swing-out position of the supporting arm and that each blocking device can be blocked for itself relative to the traveling carriage in its inactive position. In this way it is also possible in an amazingly simple manner to block the supporting arm selectively at the right or left traveling carriage for the horizontal displacement of the closure which is located in parallel-stop position. It is particularly desirable in each case that the blocking device which is associated with the leading traveling carriage of the closure, when situated in the shift-close direction, be positively controllable through an actuating link which is fixedly located on the frame relative to the supporting arm between its inactive position and its blocking position. This is, so that it can be transferred through the start of the traveling motion in open-shift direction from its inactive position into the blocking position and by the termination of the traveling motion of the traveling carriage in close-shift direction from its blocking position into the inactive position.

In the simplest case, the blocking device can consist of a two-armed latch pivotally mounted on the traveling carriage in a vertical plane whose one lever arm interacts with the end of the supporting arm at the side of the traveling carriage as a blocking device, while its other lever arm is assigned as a control element to the actuation link on the frame side. Naturally, it is also possible to use a blocking device with the construction shown in German Patent Application No. P 36 38 456.2.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
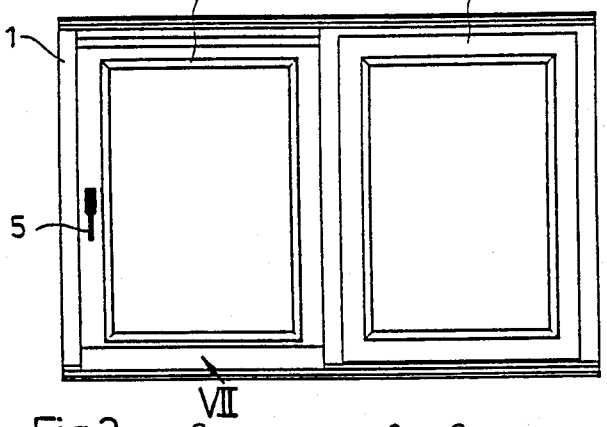
FIGS. 1 and 2 show front and side elevations of a parallel stoppable tip-slide door in the closed position of the closure.
Figure 2:
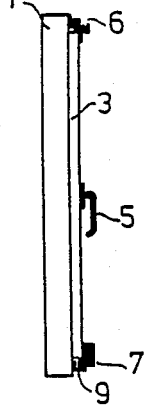

FIGS. 1 to 6 of the drawing illustrated a balcony or terrace door 1 which displays in a stationary frame 4 a permanently fixed closure 2 and movable closure 3.

Figure 3:
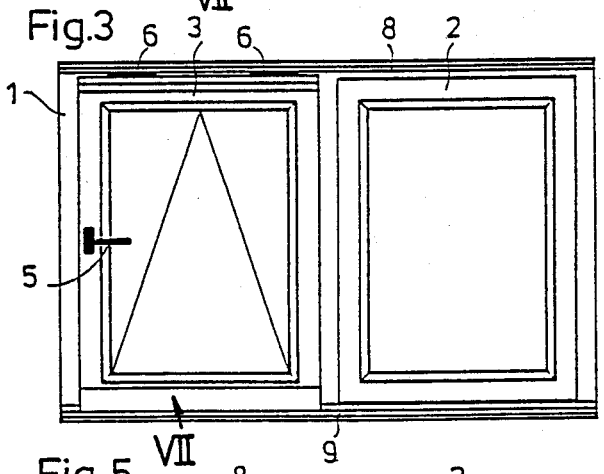
FIGS. 3 and 4 show front and side elevations of the door with the closure opened in tilt position.
Figure 4:
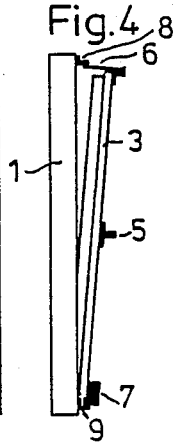
Figure 5:
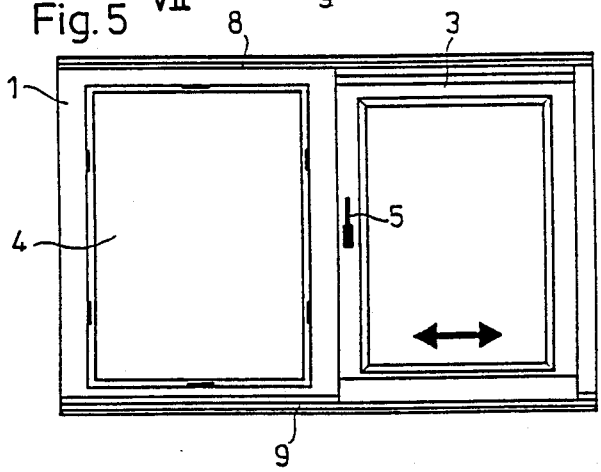
FIGS. 5 and 6 show front and side elevations of the door with the closure stopped in parallel position and shifted into opened position.
Figure 6:
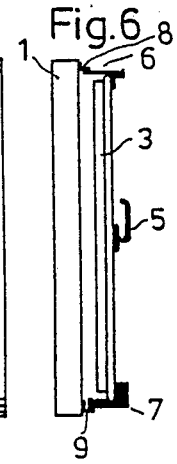

The movable closure 3 can hereby be moved (relative to the stationary frame 1 and to the door panel or fixed closure 2) from the closed position (indicated in FIGS. 1 and 2) either into a tip-open position (as can be seen in FIGS. 3 and 4) or into a parallel-stopped position in front of the stationary frame 4 and the firmly mounted closure 2. It can then be moved out of the area of the passage opening of the stationary frame 4 in the horizontal direction to a location in front of the fixed closure 2, as can be seen in FIGS. 5 and 6.

In order to make possible these three positions of the closure 3 relative to the stationary frame 1 and to the fixed closure 2, there is provided between the closure 3 and the stationary frame 1 a special hardware arrangement. This hardware is a so-called "tip-parallel-stop-slide" fitting which can be seen in FIGS. 1 to 6 as simply an operating handle 5 on the closure 3 and the upper swing hardware 6 and the lower swing hardware 7 between closure 3 and stationary frame 1.

From the aspect of kinematics, the upper swing hardware 6 and the lower swing hardware 7 can be designed similarly. The basic design of the upper swing hardware 6 can, however, be derived also from such types of construction as shown in the U.S. Pat. No. 4,384,429.

The lower swing hardware 7 must in any event be designed so that it reliably carries the weight of the movable closure 3, while it interacts with a guide rail 9 mounted on the lower transverse bar of the stationary frame 1.

Figure 7:
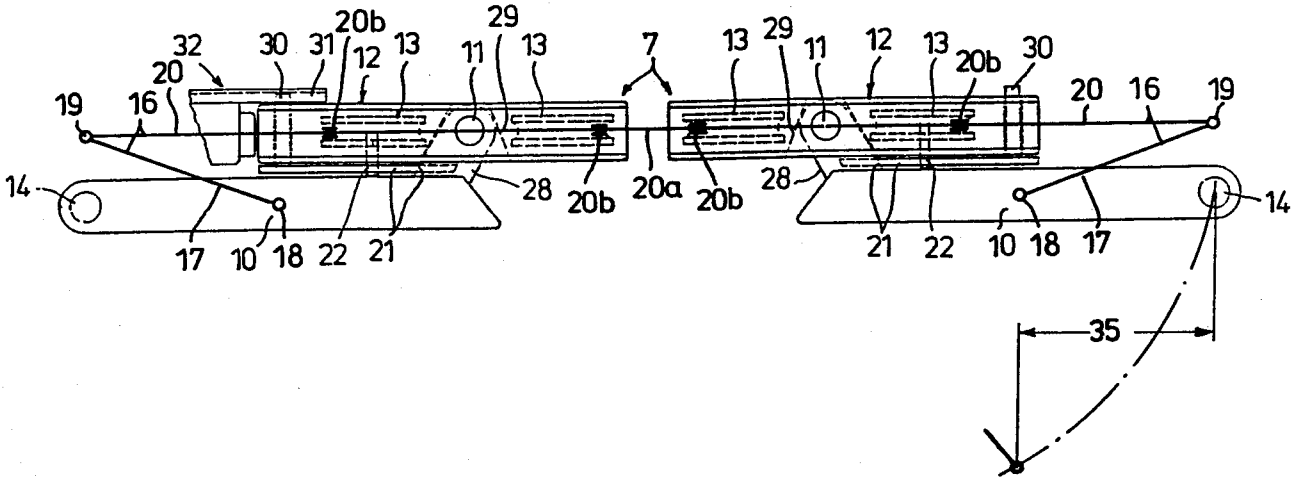
FIG. 7 shows hardware used in the FIGS. 1 and 3 in the region VII in top view and in its operative position corresponding to the FIGS. 2 and 4.
Figure 8:
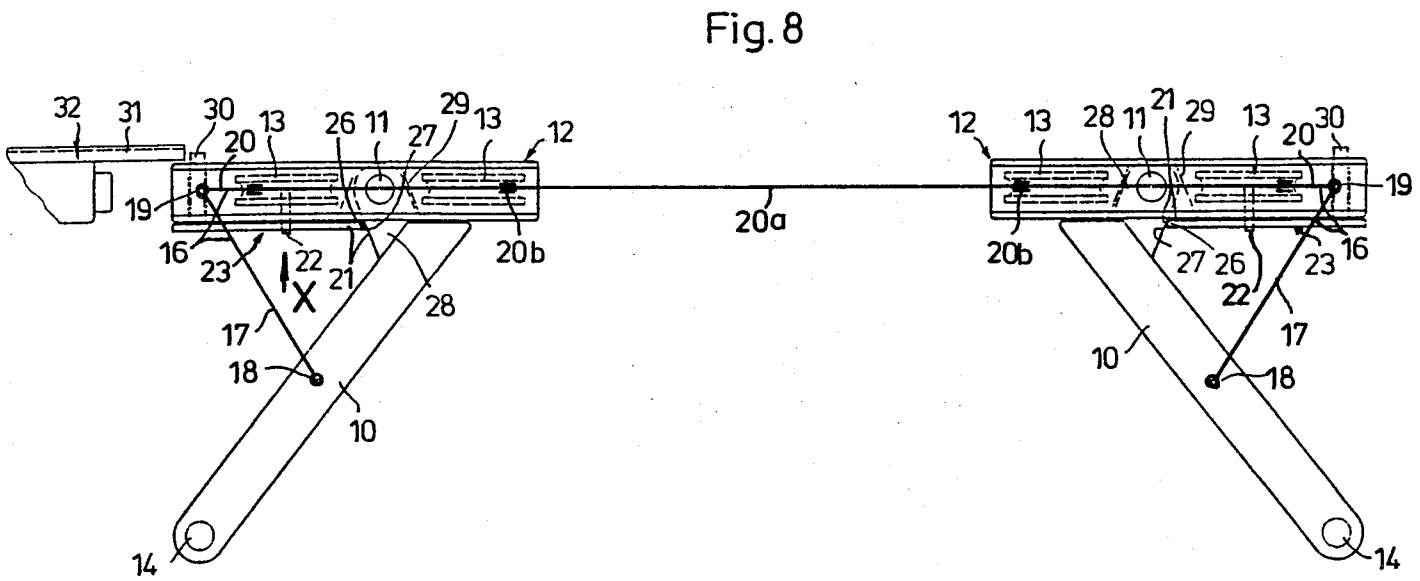
FIG. 8 shows the essential part of the hardware of FIG. 7 in its operative position corresponding to the FIGS. 5 and 6.
Figure 9:
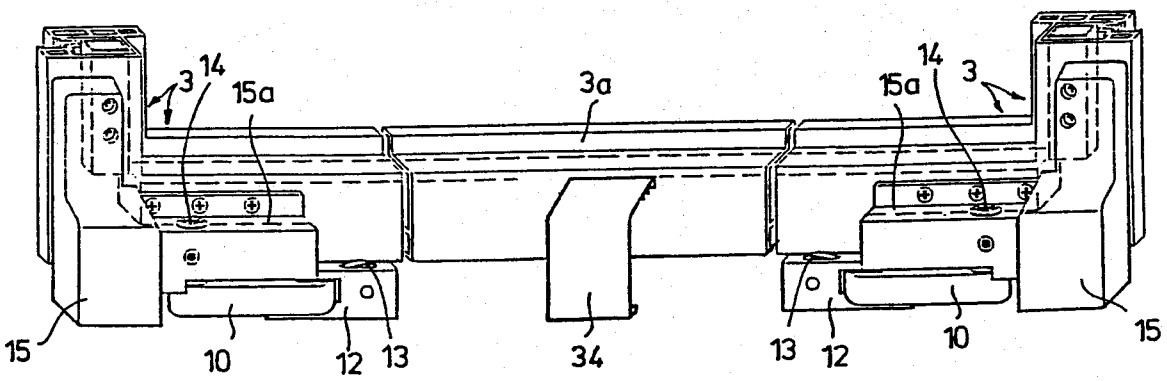
FIG. 9 shows in front elevation the lower cross section of the closure with the hardware in the operative position corresponding to FIGS. 1 to 4.

The present invention is concerned mainly with the construction and method of operating of the lower swing hardware 7, which is shown in the FIGS. 7 and 8 in its basic make-up and in top view, while FIG. 9 represents the swing hardware 7 in perspective. The swing hardware 7 uses two supporting arms 10, each of which one is pivotally articulated by a pivot pin 11 essentially in the horizontal plane to a traveling carriage 12. Each traveling carriage 12 is provided with two rollers 13 which are pivotally mounted on horizontal axes by means of which it is movably carried on the guide rail 9 of the stationary frame 1 for movement parallel to its plane.

In the region of the front of each of the two corners of the closure 3 is mounted a bearing block 15 which has an angular shape, as can clearly be seen in FIG. 9. The two bearing blocks 15 are constructed to be mirror images of one another, so that in each case there is received in its horizontal leg 15 the associated supporting arm 10 and the pivot pin 14. Also, the two supporting arms 10 and the two traveling carriages 12 are constructed to be mirror images to one another and so arranged that the lower swing hardware 7 is formed by two identically-designed but mirror image units.

As may be seen especially in FIGS. 7 and 8, the two traveling carriages 12 are movably and contra-rotatingly connected to one another through a differential coupling gear 16.

This differential coupling gear 16 is provided at each of the two traveling carriages 12 with a thrust piece 20, so that this thrust piece 20 extends in the longitudinal direction or, in other words, parallel to the direction longitudinally-movable connection (20*b*) with it.

Each thrust piece 20 engages at one end with a guide rod 17 through a swivel connection 19, which on the other side is connected, through a similar joint 18, to the supporting arm 10 which is pivotally held in the respective traveling carriage 12 by the pivot pin 11.

The supporting arm 10 and guide rod 17 interact with the traveling carriage 12 and with the thrust piece 20 in the manner of a so-called "universal joint". The operative connection is, therefore, of such a type that the longitudinal displacement of the thrust piece 20 relative to the traveling carriage 12 which guides it (brought about through the guide rod 17) corresponds to the swivel curvature radius 35 of the end 14 of the supporting arm 10 engaging closure 3 on its swivel motion around the pivot pin 11 at the traveling carriage 12.

Since the direction of motion of the thrust pieces 20 (because of the elliptical guide kinetics of the differential coupling gear 16) is enforced opposite to the similar swivel movement of the supporting arms 10 around their pivot pins 14 at the side of the closure, the two traveling carriages 12 execute, relative to each other, on the stationary guide rail 9 mutually opposite guided motions. During the movement of the supporting arms 10 from the functional position of FIG. 7 to the functional position of FIG. 8, the traveling carriages 12 are forced to move away from each other by the differential coupling gear 16. In reverse, they are again forced to move nearer to each other by the differential coupling gear 16 during the swivel movement of the supporting arms 10 from the active position shown in FIG. 8 to the active position shown in FIG. 7.

The enforced control of the trapezoid guide rod system of the hardware 7 in the region of the two traveling carriages 12, as effected through the differential coupling gear 16, provides that (despite mutually contrary swivel movement of the two supporting arms 10) a synchronous shift of the closure 3 takes place transversely of the plane of the stationary frame 1.

In order that the closure 3, during its horizontal shift remain constantly reliably in the parallel stop position relative to the stationary frame 4, it is necessary to lock the supporting arms 10 of the lower swing hardware 7 against the stationary frame 1 or against the traveling carriage 12 (guided upon its guide rail 9). This is done by means of a special blocking device 21. At the same time it is necessary that, by release of the blocking device 21, the locking of the parallel stop position for the swing-out arms 10 be removed as soon as the closure 3 reaches its shift-close end position in order that it can be moved from the position of FIG. 8 into the position of FIG. 7 against the stationary frame 1.

Figure 10:
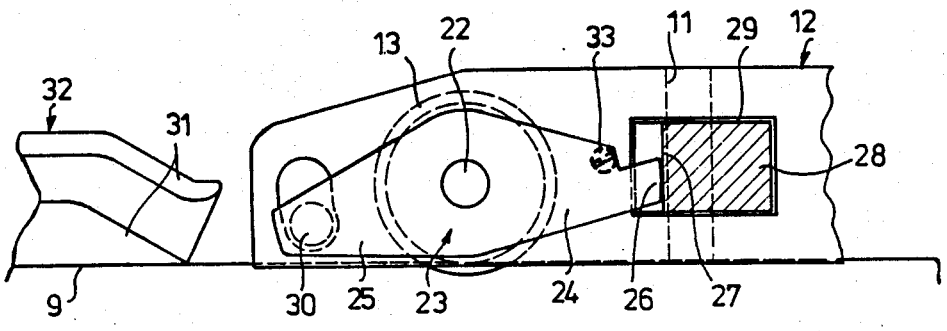
FIG. 10 shows the hardware as viewed in the direction X of the FIG. 8 showing a blocking device arranged between the traveling carriage and the supporting arm in its blocking position.
Figure 11:
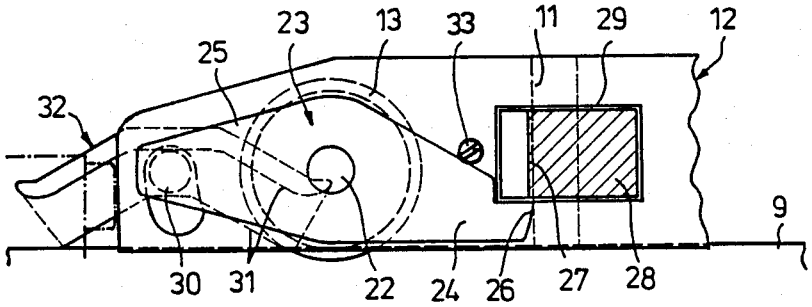
FIG. 11 shows the blocking device of FIG. 10 in its inactive position.

In accordance with FIGS. 7 and 8, there, is assigned to each on of the two traveling carriages and the supporting arms 10 hinged thereto, their own blocking device 21, wherein the arrangement and method of operation of such a blocking device 21 can be seen in FIGS. 10 and 11. On each traveling carriage 12 is pivotally mounted (for example, on the extended pivot pin 22 of a roller 13) a latch 23 extending in vertical direction, which latch forms a two-armed lever whose lever arms 24 and 25 extend from the pivot pin 22 in opposite directions. The lever arm 24 faces the end of the traveling carriage side of the supporting arm 10, in such a manner that its free end edge 26 can come into operative engagement with a supporting surface 27 of a bearing eye 28. This eye projects laterally from the supporting arm 10 at an obtuse angle and extends into a cutout 29 in the traveling carriage 12 which is penetrated by the pivot pin 11.

In the parallel stop position of the supporting arm 10 (as shown in FIG. 8) the transverse edge 26 of the lever arm 24 can arrive at the support surface 27 and at the bearing eye 28 of the supporting arm 10. In can, thereby, block this arm against an inward swing relative to the traveling carriage 12 into the position of FIG. 7. The lever arm 24 of the latch 23 forms thus the actual blocking member of the blocking device 21 through which the parallel-stop position of the supporting arm 10 against the, traveling carriage 12 is locked.

In order that the supporting arm 10 be released relative to the traveling carriage 12 for a swivel motion as soon as the closure reaches, during its horizontal shifting, the shift-close end position against the stationary control cam 30 with a cam 31 of an actuation link that is firmly fixed at the stationary frame 1, as is shown in FIGS. 10 and 11. When the closure 3 is moved relative to the stationary frame 1 in the opening mode (in FIGS. 10 and 11 from left to right) in the horizontal direction, then the latch 23 is forced to pivot by the control cam 30 and control cam 31. The end edge 26 of its lever arm 24 comes in front of the support surface 27 of the bearing eye 28 at the supporting arm 10 and blocks or fixes it in the parallel-stop position (FIG. 8) against the traveling carriage 12. When, however, the closure 3 is shifted relative to the stationary frame 1 in the closing mode (FIGS. 10 and 11) from right to left in the horizontal direction, then a swivel movement is forced upon the latch 23 by the control cam 30 and the cam 31. In this way the end edge 26 of its lever arm 24 emerges from the region of the support surface 27 of the bearing eye 28. The supporting arm 10 then is free of the traveling carriage 12 and is free to swing around the pivot pin 11 from the parallel-stop position of FIG. 8 to the closed position of FIG. 7.

Each of the two traveling carriages 12 of the hardware is equipped with its own blocking device 21. Merely one of these blocking devices 21 is, however, sufficient to ensure the parallel-stop position of both supporting arms 10 of the hardware 7, because they are in positional connection gearwise with each other by means of the coupling gear 16.

In a practical application, it has proved to have in operation only the blocking device 21 between the traveling carriage 12 of the closing side and its supporting arm 10, while simultaneously the blocking device 21 of the other traveling carriage is fixed in its inoperative position by means of a clamp bolt 33.

It is, of course, possible to make the blocking devices 21 of both traveling carriages 12 operative and thereby to form and arrange the assigned actuation links 32 of the frame side in such a way that they ensure a proper motional control of both blocking devices 21.

Finally, it should be mentioned that (as shown in FIG. 9) a cover profile 34 can be attached between the two bearing blocks 15 at the lower transverse closure bar 3*a*.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letter Patent is:

1. Hardware (6, 7) for a closure (3) of a window, or door, which closure is lockable in a position parallel to a fixed frame and in this position is horizontally shiftable, the hardware having lower supporting arms (10) and upper swing arms, in which the lower supporting arms (10) are mounted by a first pivot pin (14) to a lower transverse bar of the closure in a bearing block (15) and which are also each pivotally mounted on a traveling carriage (12) by a second bearing pivot pin (11), in which a releasable blocking device is provided for at least one of the lower supporting arms (10) when the closure is in said parallel position, which blocking device can be brought into and out of blocking engagement relative to the supporting arm (10) in conjunction with an end motion of the closure (3) as it is shifted to a closed position characterized by the fact that:

said traveling carriages (12), along with each associated supporting arm (10) and each associated bearing block (15) on the closure side, from assemblies which are mirror images of one another, and are connectable for forced movement relative to one another by a differential coupling apparatus (16), by the fact that:

each traveling carriage (12) carries a thrust piece (20) to which is articulated a guide rod (17) by a pivot pin (19), the rod being connected by a swivel (18) to the supporting arm (10), so that the sliding path of the thrust piece (20) and of the guide rod (17) relative to the traveling carriage (12) corresponds to the component of displacement (35) (in the same direction) of the first pivot pin (14) of the supporting arm (10) swinging about the closure (3) on its second bearing pivot pin (11), and by the fact that:

the thrust pieces (20) of both carriages are coupled with one another by means of an intermediate piece (20*a*) which can be adjusted in length.

2. Hardware as recited in claim 1, characterized by the fact that between each traveling carriage (12) and the supporting arm (10) mounted thereon, a blocking device (21) is provided which is activated at the swing-out position of the supporting arm (10), and that each blocking device (21) is individually blockable relative to the traveling carriage (12) when the blocking device is in an inactive position (33).

3. Hardware as recited in claim 2, characterized by the fact that in each case the blocking device (21) assigned to the traveling carriage (12) as it advances in the shifting and closing direction of the closure is positively controllable between its inactive position and its blocking position, by means of a frame-side mounted stationary actuating link (31, 32) relative to the supporting arm (10) whereby the start of the traveling motion of the traveling carriage (12) into its open and shifted out position activates a change from inactive position of the blocking device blocking position and whereby termination of the traveling motion of the traveling carriage (12) into closed and shifted in position activates a change from blocking position of the device into its inactive position.

4. Hardware as recited in claim 3, characterized by the fact that the blocking device (21) consists of a latch (23) pivotally mounted (22) on the traveling carriage (12) and extending out from a vertical plane, having a first lever arm (24) interacting with an end (27, 28) of the supporting arm (10) of the side of the traveling carriage, the arm acting as blocking link (26), while having a second lever arm (25) associated with the frame-side actuation link (31, 32) and acting as a control element (30).

* * * * *